US005392598A

United States Patent [19]

White et al.

[11] Patent Number: 5,392,598

[45] Date of Patent: Feb. 28, 1995

[54] INTERNAL COMBUSTION ENGINE AIR/FUEL RATIO REGULATION

[75] Inventors: Vincent A. White, Northville; Hossein Javaherian, Rochester Hills, both of Mich.

[73] Assignee: General Motors Corporation, Detroit, Mich.

[21] Appl. No.: 132,944

[22] Filed: Oct. 7, 1993

[51] Int. Cl.[6] ..... F01N 3/20

[52] U.S. Cl. ..... 60/274; 60/276; 60/285; 123/703

[58] Field of Search ..... 60/274, 276, 285, 277; 123/672, 703

[56] References Cited

U.S. PATENT DOCUMENTS 4,278,060 7/1981 Isobe et al. .
4,625,698 12/1986 Jamrog .
4,817,383 4/1989 Masul .
4,817,384 4/1989 Okumura et al. .
5,025,767 6/1991 Kume et al. .
5,282,360 2/1994 Hamburg et al. ..... 60/274
5,291,673 3/1994 Hamburg et al. ..... 60/274
5,293,740 3/1994 Heppner et al. ..... 60/274

OTHER PUBLICATIONS

Closed Loop Carburetor Emission Control System–R. A. Spilski and W. D. Creps pp. 145–154.

*Primary Examiner*—Ira S. Lazarus
*Assistant Examiner*—Daniel J. O'Connor
*Attorney, Agent, or Firm*—Michael J. Bridges

[57] ABSTRACT

Internal combustion engine air/fuel ratio regulation in which closed-loop air/fuel ratio control responsive to a pre-converter oxygen sensor feedback signal is further regulated in accord with a feedback signal from a post-converter oxygen sensor signal operative under certain engine operating conditions to provide an average actual engine air/fuel ratio signal. A pre-converter oxygen sensor rich/lean threshold is adjusted in accord with the post-converter signal to drive or maintain such post-converter signal within a preferred range corresponding to an average engine air/fuel ratio of stoichiometry.

12 Claims, 4 Drawing Sheets

INTERNAL COMBUSTION ENGINE AIR/FUEL RATIO REGULATION

FIELD OF THE INVENTION

This invention relates to internal combustion engine air/fuel ratio control and, more specifically, to fuel compensation responsive to a plurality of exhaust gas oxygen sensors.

BACKGROUND OF THE INVENTION

It is generally known that the amount of hydrocarbons, carbon monoxide and oxides of nitrogen emitted through operation of an internal combustion engine may be substantially reduced by controlling the relative proportion of air and fuel (air/fuel ratio) admitted to the engine, and by catalytically treating the engine exhaust gas. A desirable air/fuel ratio is the stoichiometric ratio, which is known to support efficient engine emissions reduction through the catalytic treatment process. Even minor deviations from the stoichiometric ratio can lead to significant degradation in catalytic treatment efficiency. Accordingly, it is important that the air/fuel ratio be precisely regulated so as to maintain the actual engine air/fuel ratio at the stoichiometric ratio.

Closed-loop control of internal combustion engine air/fuel ratio has been applied to drive the actual air/fuel ratio toward a desired air/fuel ratio, such as the stoichiometric air/fuel ratio. This control benefits from an estimate of actual engine air/fuel ratio, such as from an output signal of an oxygen sensor disposed in the engine exhaust gas path. The estimate is applied to a control function responsive to air/fuel ratio error, which is the difference between the estimate and the desired air/fuel ratio.

The oxygen sensor may be a conventional zirconia oxide $ZrO_2$ sensor which provides a high gain, substantially linear measurement of the oxygen content in the engine exhaust gas. A lean engine air/fuel ratio corresponds to a $ZrO_2$ sensor output signal below a predetermined low threshold voltage and a rich engine air/fuel ratio corresponds to an output signal above a predetermined high threshold voltage.

$ZrO_2$ sensors are disposed in the exhaust gas path in position to measure the oxygen content of the engine exhaust gas, such as upstream of the catalytic treatment device (catalytic converter). Such pre-converter sensors have contributed to success in engine emissions reduction efficiency. However, certain effects, such as sensor or converter aging (catalyst depletion) and sensor contamination may degrade emission reduction efficiency and may be left uncompensated in traditional closed-loop control.

$ZrO_2$ sensors may also be positioned in the engine exhaust gas path downstream from the catalytic converter. For example, post-converter sensors have been applied for converter diagnostics, or for outright engine air/fuel ratio control.

Post-converter sensors are in position to provide information on the emission reduction efficiency of the air/fuel ratio control system including the pre-converter sensor and the catalytic converter. Accordingly, it would be desirable to apply information from a post-converter oxygen sensor in engine air/fuel ratio control responsive to a pre-converter oxygen sensor so as to compensate any degradation in the efficiency of the control to reduce undesirable engine emissions.

SUMMARY OF THE INVENTION

The present invention provides the desired improvement by compensating the pre-converter sensor-based engine air/fuel ratio control with information from a post-converter sensor.

Specifically, an additional control loop is appended to a feedback control loop including information from a pre-converter oxygen sensor. The additional control loop includes information from a post-converter oxygen sensor. Such information indicates emission reduction performance of the pre-converter oxygen sensor-based control loop and thus may be used to compensate such control loop in a manner improving such performance.

In an aspect of this invention, the post-converter sensor output is compared to a calibrated range, and a threshold value to which the pre-converter output signal is compared in the pre-converter control loop is adjusted in accord with the comparison. In a further aspect of this invention, an error signal is generated based on the difference between the post-converter sensor output signal and the calibrated range. An error signal difference value is then generated and an adjustment value determined as a predetermined function of the error signal and difference value. The pre-converter threshold value is then adjusted by the adjustment value.

In yet a further aspect of the invention, the degree of the adjustment and the rate at which it is applied may vary with the engine operating range.

BRIEF DESCRIPTION OF THE DRAWINGS

The invention may be best understood by reference to the description of the preferred embodiment and to the drawings in which.

DESCRIPTION OF THE PREFERRED EMBODIMENT

Figure 1:
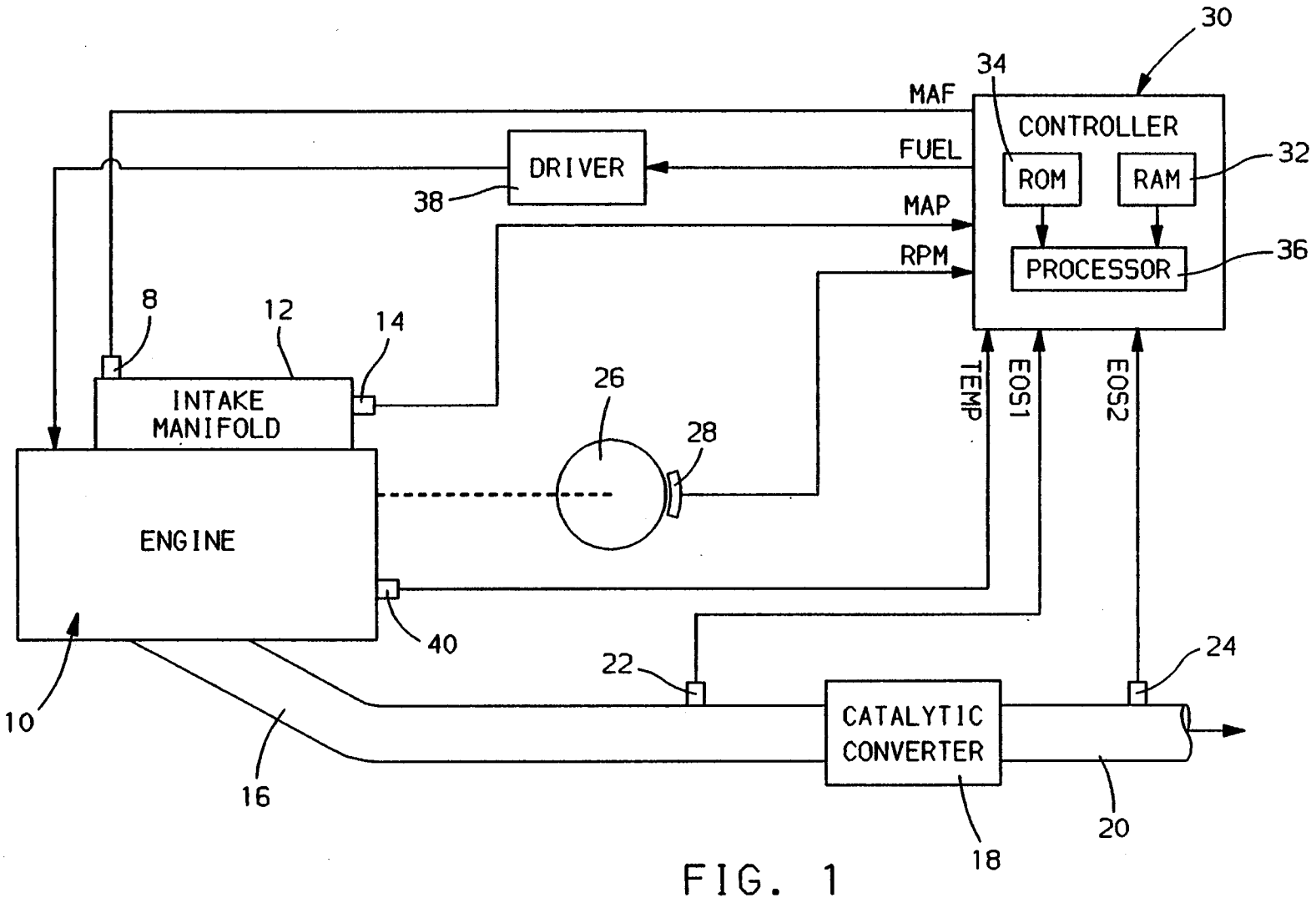
FIG. 1 is a general diagram of the engine and engine control hardware in which the preferred embodiment of this invention is applied.

Referring to FIG. 1, an engine 10 having an intake manifold 12 through which an intake air charge passes to the engine, combines the air charge with at least a fuel charge from a fuel delivery means such as one or more conventional fuel injectors (not shown) driven by driver circuit 38. Driver circuit 38 receives a periodic fuel command FUEL, for example in the well-known form of a fixed amplitude, fixed frequency, variable duty cycle pulse width command from a controller 30.

The fuel/air combination is substantially consumed through normal engine operation, the waste products from the consumption being expelled from the engine to exhaust gas conduit 16, and being guided thereby to conventional three way catalytic converter 18, which attempts to convert and/or reduce the constituent exhaust gas elements of hydrocarbon, carbon monoxide, and oxides of nitrogen to less noxious emissions, which are expelled from the exhaust path through conduit 20.

Controller 30, such as a conventional single-chip eight-bit microcontroller, includes the well-known elements of a processor 36, read only memory ROM 34 and random access memory RAM 32. Non-volatile RAM may be included simply as RAM that is not cleared when power is applied to the controller to start its operation. Information not intended to vary through the operation of the controller 30 may be stored in ROM 34, information that may vary while the controller is operating may be stored in RAM 32, and variable information that is intended to be maintained from operation to operation of the controller may be stored in non-volatile RAM.

The controller, when activated through application of power thereto, reads step by step instructions from ROM 34, and executes the instructions to carry out engine control in a conventional manner, such as by reading and processing engine control input signals from various engine parameter sensors and by generating and applying engine control output signals to appropriate engine control actuators.

Included as engine control input signals are MAF, MAP, RPM, TEMP, EOS1 and EOS2. MAF is a mass airflow signal output by conventional mass airflow sensor 8 located in the inlet air path, such as in position to sense the mass of air passing thereby prior to such air entering intake manifold 12. The magnitude of MAF is proportional to an estimate of the mass of air entering the engine.

MAP is a signal generated by pressure sensor 14 and proportional in magnitude to the absolute air pressure in intake manifold 12. RPM is a signal the frequency of which is proportional to the speed of rotation of an engine output shaft 26, such as the engine crankshaft. Signal RPM may be generated by positioning a conventional variable reluctance sensor 28 in proximity to a circumferential portion of the shaft 26 having teeth, such that the teeth pass by the sensor at a frequency proportional to the rate of rotation of the shaft.

TEMP is a signal proportional in magnitude to engine coolant temperature, as may be generated by conventional engine coolant temperature sensor 40 disposed in the engine coolant circulation path (not shown). EOS1 is an exhaust gas oxygen sensor signal the magnitude of which indicates the oxygen content in the engine exhaust gas passing in proximity to the sensor. EOS1 may be generated by a conventional oxygen sensor 22, such as a zirconium oxide $ZrO_2$ sensor.

EOS2 is a second exhaust gas oxygen sensor signal having an output magnitude indicative of the oxygen content passing in proximity to the conventional oxygen sensor 24 which produces EOS2. EOS1 is generated at a point in the engine exhaust gas path upstream of the catalytic converter 18 so as to indicate the oxygen content in the exhaust gas before such gas is catalytically treated by the converter 18. Alternatively, EOS2 is placed downstream of the catalytic converter 18 to indicate the oxygen content in the catalytically treated engine exhaust gas.

As described, the engine controller 30 executes a series of steps, such as in the form of a series of instructions stored in ROM 34, to carry out the engine control of this embodiment. Conventional control of engine ignition, intake fuel and intake air may be provided through execution of such routines.

For example, closed-loop fuel control may be executed by such steps, wherein a signal such as EOS1 indicating the actual engine air/fuel ratio status (rich or lean) may be used to adjust a fuel command FUEL, for a sensed intake air rate and intake air density, to drive the actual air/fuel ratio toward a beneficial air/fuel ratio, such as the stoichiometric ratio for efficient catalytic treatment thereof, as described.

Such closed-loop control may compare the magnitude of EOS1 or a value representing the magnitude of EOS1 over a length of time or number of samples, such as an average value or integrated value, to upper and lower threshold values which based, according to well-known relationships, on a reference voltage Vref. If the EOS1-based value exceeds the upper threshold value, a rich air/fuel ratio condition may be diagnosed, and the fuel pulsewidth command FUEL decreased, such as by an amount determined through application of known classical or modern control techniques, to increase the actual engine air/fuel ratio and mitigate the condition.

Alternatively, if the EOS1 based value is less than the lower threshold value, a lean air/fuel ratio condition may be diagnosed, and the fuel pulsewidth FUEL increased, such as by an amount determined through application of known control techniques in response thereto, to decrease the actual engine air/fuel ratio and mitigate the condition.

The routines to carry out this closed-loop operation are consistent with general practice in the engine fuel control art, and are not further detailed herein. The routines illustrated in FIGS. *2a–2c* are included to detail the manner in which EOS2, the output of the second oxygen sensor 24 (FIG. 1) may be used along with the aforementioned conventional closed-loop fuel control approach, to improve the precision of the control, especially over time as the closed-loop control hardware deteriorates in accuracy or efficiency.

Generally, this routine adjusts Vref, the basis for the upper and lower thresholds compared to the output of the pre-converter oxygen sensor in the conventional engine air/fuel ratio control of this embodiment. Such adjustment of the present routine thereby drives the engine air/fuel ratio toward a ratio at which efficient catalytic treatment of the exhaust gas may occur, despite any deterioration in catalytic converter 18 (FIG. 1) efficiency or despite any reduction in the accuracy of the pre-converter oxygen sensor (such as sensor 22 in FIG. 1) or other emission control hardware components.

Specifically, the routine of FIGS. *2a–2c* are periodically executed starting at step 60, such as approximately every 12.5 milliseconds while the controller 30 is operating. The routine proceeds from step 60 to step 62, to determine if START FLAG is clear, indicating that the present routine has not been executed since non-volatile RAM of controller 30 (FIG. 1) was most recently cleared. Certain variables must, in the present embodiment, hold their values after controller 30 stops executing engine control, such as when ignition power is removed from controller 30. Such variables must be stored in non-volatile RAM, as described, and must be initialized during the first iteration of the present routine after non-volatile RAM has been cleared, as indicated by non-volatile RAM variable START FLAG being cleared.

For example, if, at step 62, START FLAG is clear, the routine moves to step 64, to initialize non-volatile RAM variables. Specifically, each of a set of values $\epsilon(.)$, to be described, are set to zero, OLDSTATE is set to a value RICH representing a rich air/fuel ratio condition, START FLAG is set to one, and oxygen sensor ready flag RFLAG is cleared indicating the oxygen sensor may not be ready to be used as a control input, as will be described.

After initializing these non-volatile RAM variables, or if START FLAG was determined at step 62 to be set, the routine moves to step 66 to set MODE in accord with the current engine operating condition as the one of a class of modes most accurately describing the current engine operating state. For example, in the present embodiment, the engine operating state may be classified as one of the following: IDLE, DECELERATION, CRUISE, LIGHT ACCELERATION, and HEAVY ACCELERATION.

Engine operating parameters that may be used to indicate which mode the engine may be in include engine speed or change in engine speed, both derived in a conventional manner from signal RPM, and engine load and change in engine load, both of which may be derived in a conventional manner from signal MAP. By comparing these input parameters or other engine parameters generally known to indicate the engine operating level to predetermined parameter ranges, a classification may be made as to the present operating mode of the engine. MODE is then set at step 66 to a value to indicate the present active mode.

After setting MODE, the routine moves to step 68, to read V, the voltage magnitude of the output signal of post-converter exhaust gas oxygen sensor 24 (the sensor in privity to the catalytically treated exhaust gas). The routine then determines Vf, a filtered version of V, at step 70 by passing V through a conventional first order filter process as follows $$Vf=af*Vf+(1-af)*V$$

in which af is a first order filter coefficient set in this embodiment close to unity, such as between 0.8 and 0.9, to provide moderate first order filtering of the signal V.

After filtering V at step 70, the routine moves to steps 72–80, to determine whether conditions are appropriate for proceeding with the compensation of the present routine. Specifically, the routine first checks coolant temperature at step 72, by reading signal TEMP and comparing it to a predetermined temperature threshold, such as forty degrees Celsius in this embodiment.

If TEMP is below this threshold, it is assumed the engine 10 is of insufficient temperature to heat the oxygen sensor 24 (FIG. 1) to its operational temperature. As is generally known in the art of closed-loop engine air/fuel ratio control, conventional $ZrO_2$ sensors, such as those of the present embodiment, must be heated up to a characteristic temperature before providing stable and accurate oxygen content information. Such sensors may be heated, or may rely on engine heat, such as passed to the sensor in the form of exhaust gas heat energy, to elevate their temperature.

The present step 72 is provided in the event the sensor relies on engine heat for its heating. If the engine coolant temperature is not elevated to To degrees, then it has been determined, such as through a conventional calibration step, that the oxygen sensor 24 (FIG. 1) will not likely be operational. Accordingly, the analysis of the present routine, Which relies on information from such sensor 24 will be avoided when TEMP is less than To at step 72, by moving to step 126 to reset OLDSTATE, to be described, to a default setting of RICH, and then by exiting the routine via step 94.

Alternatively at step 72, if TEMP does exceed To, the routine moves to step 74, to determine if the fuel control loop is operating in closed-loop control as indicated by flag CLFLAG, which is set to one when such closed-loop control is active. If closed-loop control is not active, the upstream oxygen sensor 22 (FIG. 1) is not being used for engine air/fuel ratio control and, as such, the present routine need not update Vref. In such a case, the routine moves to the described step 126.

However, if CLFLAG is set at step 74, the routine moves to step 76, to compare a closed-loop correction factor CORRCL to a calibrated value Δ, set at 16 in this embodiment. CORRCL is a closed-loop correction value used, in accord with generally known closed-loop air/fuel ratio control practice, to compensate for deviations between actual air/fuel ratio and a desired air/fuel ratio, such as the stoichiometric ratio. CORRCL ranges in magnitude from 0 to 255 in the present embodiment, with 128 corresponding to a zero correction value. CORRCL is set up to rapidly increase or decrease as necessary to provide air/fuel ratio compensation, and is reduced toward zero slowly through the compensation provided by a second compensation value, such as a block learn value.

The block learn value responds more slowly to air/fuel ratio deviations than does CORRCL. Both values are applied to fuel command FUEL in the present embodiment to drive the actual air/fuel ratio toward the desired air/fuel ratio. Any deviation left uncompensated by the block learn value is addressed by the magnitude of the CORRCL, such that, eventually, after an air/fuel ratio perturbation, CORRCL may be reduced to a zero compensation value through the gradual increase in the block learn compensation. It should be noted that the inventors intend that the value Δ need not be fixed at 16 counts for all operating modes, but indeed may vary as a function of the mode currently active, as set at step 66 of the present routine. Typically, Δ ranges from six to sixteen counts over the modes of the present embodiment.

Figure 2A:
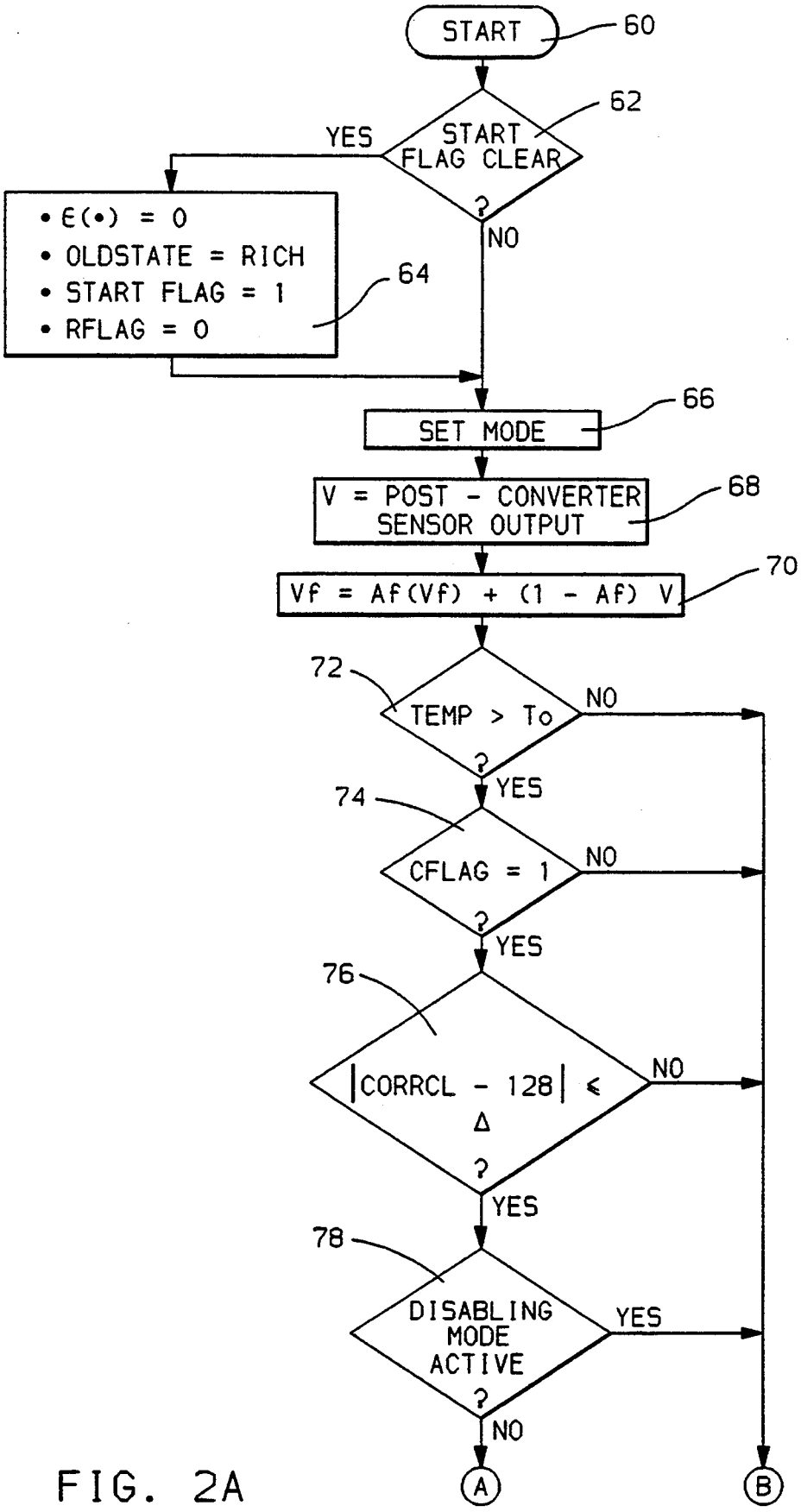
FIGS. 2*a*–2*c* are computer flow diagrams illustrating the steps used to carry out the present invention in accord with the preferred embodiment.

Returning to step 76 of the routine of FIG. 2*a*, if the magnitude of CORRCL is determined to have deviated from 128 by an amount exceeding Δ, then that conventional portion of air/fuel compensation of the present embodiment is still responding to a significant deviation between actual and desired air/fuel ratio, such that the block learn value has not yet mitigated the deviation to the extent necessary to reduce CORRCL close to 128. Under such conditions, the inventors have determined that the fine adjustment in the air/fuel ratio compensation provided in accord with the present invention should be deferred, to allow the more granular conventional compensation to singularly compensate the air/fuel ratio deviation.

Accordingly, the compensation is avoided in the present iteration when the magnitude of (CORRCL−128) exceeds Δ, by moving from step 76 to the described step 126. Alternatively at step 76, if the magnitude of CORRCL is less than or equal to Δ, the routine moves to step 78 to verify that closed-loop engine air/fuel ratio control around the stoichiometric ratio is active, such as by verifying that certain enabling conditions for such control are met.

For example, such closed-loop control will not be active if a failure mode exists, such as would generally be understood in the art to preclude such closed-loop control, or if such control modes as acceleration enrichment, deceleration fuel cutoff, or power enrichment, as generally known in the art, are active. In the event any of such modes are active at step 78, the routine avoids compensating Vref, by moving to the described step 128.

However, if it is determined at step 78 that the modes precluding such closed-loop air/fuel ratio control around the stoichiometric ratio are not active, the analysis of the present routine continues by moving to step 82 to check the status of RFLAG, which, when set to one, indicates the post-converter oxygen sensor 24 is ready to be tested. If RFLAG is not set to one at step 82, the routine moves to steps 84 and 86 to determine whether the output signal of the sensor 24 (FIG. 1) is within a range bounded by upper voltage Eu and lower voltage El.

If the sensor output voltage magnitude is within that range, the sensor may be assumed to be of sufficient temperature to ensure a stable and accurate oxygen content indication thereby. A conventional $ZrO_2$ sensor will exhibit an output voltage of low peak to peak amplitude, such as within the range bounded by Eu and El, when insufficiently heated for use in the present control.

As described, step 72 of the present routine determines whether the engine temperature is sufficiently elevated to support such oxygen sensor accuracy and stability. The present steps 84 and 86 are provided to affirm that such engine heat has elevated the sensor temperature such that an appropriate sensor output amplitude has been sensed.

For the sensor of the present embodiment, El and Eu were determined to be approximately 0.3 and 0.6 volts, respectively. If, at steps 84 and 86, the sensor is operating outside the range bounded by El and Eu, then it is assumed to be sufficiently heated so as to be ready for use in the compensation of the present embodiment, and the routine moves to step 88 to set the sensor ready flag RFLAG to one. RFLAG is a RAM variable in the present embodiment and, as such, will be cleared at each controller power-up, to ensure the sensor adequately heats up each time the controller is restarted.

Returning to steps 84 and 86, if Vf is within the range bounded by El and Eu, the sensor is assumed to not yet be ready for use, and the compensation of the present iteration is avoided by moving to the described step 126.

After setting RFLAG to one at step 88, the routine moves to step 90 to compare TIMER, which monitors the amount of time between Vref adjustments of the present routine, to a predetermined value CORRECTION TIME, stored in ROM 34 (FIG. 1) as the desired time between Vref correction in the present embodiment. In this embodiment CORRECTION TIME is set as a function of MODE, the mode the engine is operating in as determined at step 66 of the present routine. This provides compensation consistent with the needs of an event-driven closed-loop compensation system. For example, if event driven control is operating at high frequency, the compensation of the present routine should likewise operate at high frequency. Alternatively, if the engine is in a mode characterized by low frequency control operation, the compensation provided by the present routine may have a larger CORRECTION TIME and thus a lower compensation frequency. Representative CORRECTION TIMES vary in the present embodiment, as a function of the various modes and their operating rates, generally from one to four seconds.

Returning to step 90, if TIMER is less than the CORRECTION TIME for the present mode, the routine moves to step 92 to increase TIMER by the present loop time, such as 12.5 milliseconds in the present embodiment. The routine then exits via step 94, to return to any prior routine that was being executed by the controller 30 (FIG. 1) at the time the present iteration of the routine of FIGS. 2a–2c was initiated.

Alternatively at step 90, if TIMER exceeds or is equal to CORRECTION TIME, the routine moves to step 96, to reset TIMER to zero, and then proceeds to step 98 to retrieve the $\epsilon$ stored for the present MODE. A value $\epsilon$ is stored in non-volatile RAM for each mode. Each $\epsilon$ may then be updated and restored when the corresponding mode is active and a Vref correction is required, as will be detailed.

After referencing a stored $\epsilon$, the routine moves to steps 100 and 104 to compare Vf to a voltage range defined by a lower bound voltage Vl and an upper bound voltage Vu. This range may be determined through a conventional calibration step as that range of post-converter oxygen sensor voltages associated with the most efficient catalytic treatment of engine exhaust gas. Generally, post-converter output voltage exceeding Vr indicates a rich (excess oxygen) condition and post-converter output voltage less than Vl indicates a lean (depleted oxygen) condition in the catalytically treated engine exhaust gas.

If, in accord with this invention, the output voltage of the post-converter oxygen sensor is within the range, no correction of Vref, the pre-converter reference voltage is required. However, if the post-converter output voltage is outside the range, Vref is adjusted to drive the engine air/fuel ratio in direction to move the post-converter output voltage back into the range. In this embodiment in which Vf has a range generally from zero to one volt, Vl may be selected as a value in the range of 0.57–0.59 volts, and Vr may be selected as a value in the range of 0.59–0.62 volts.

Returning to step 100, if Vf exceeds or is equal to Vr, the routine moves to step 102 to set the flag STATE to RICH, indicating the sensed rich condition for the present iteration. Additionally at step 102, RICHGAIN is decreased by a small amount KRICH, such as zero to four counts in this embodiment, and the decreased RICHGAIN added to $\epsilon$ to provide an integral gain adjustment thereto, to minimize the difference between Vf and the desirable range bounded by Vr and Vl, in accord with generally known principles of integration compensation.

Returning to step 100, if Vf is less than Vr, the routine moves to check the lean limit at step 104 by comparing Vf to Vl, wherein Vl is set in this embodiment to approximately 0.57 to 0.59 volts. If Vf is less than or equal to Vl at step 104, the routine moves to step 106 to set flag STATE to LEAN, indicating the sensed lean condition. Additionally at step 106, integral gain compensation is provided by adding KLEAN, set at a small value in this embodiment, such as zero to five counts, to LEANGAIN, and then by adding LEANGAIN to $\epsilon$. After providing the integration compensation at step 102 or 106, the routine moves to step 108, to be described.

Figure 2B:
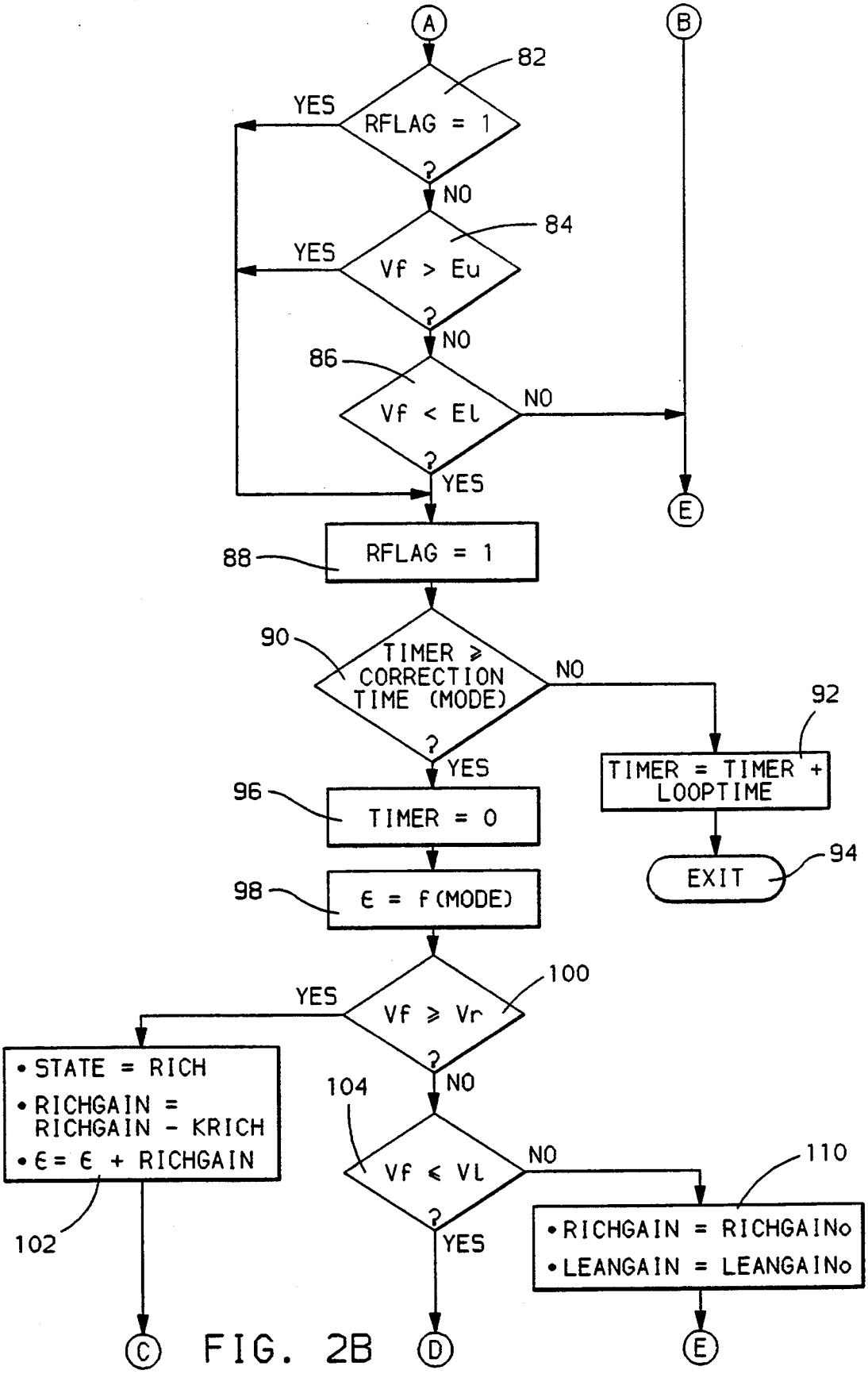
Figure 2C:
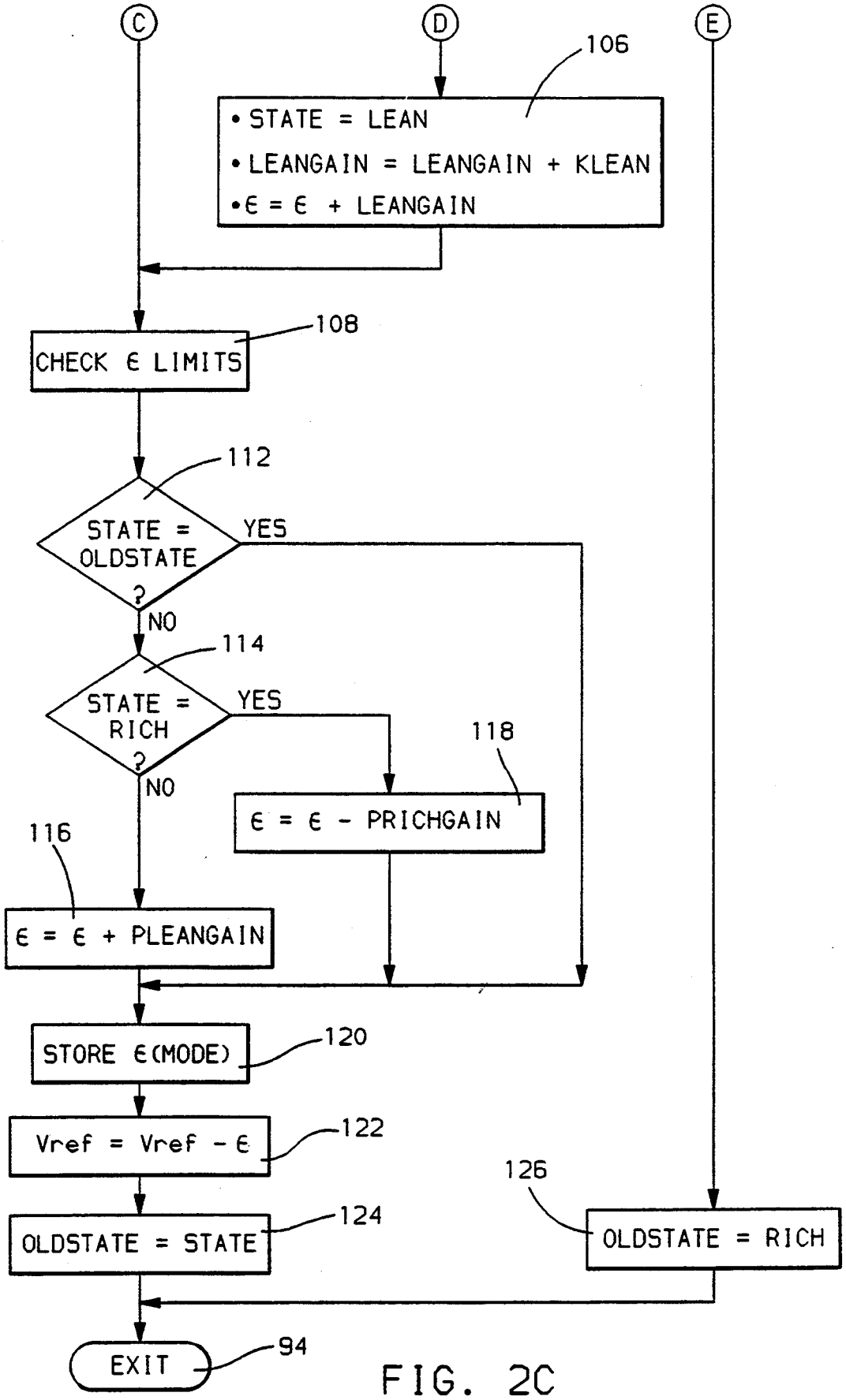

Alternatively, at step 104, if Vf is greater than Vl, no Vref compensation is assumed to be needed in the present iteration of the routine of FIGS. 2a–2c, and step 110 is executed to reset RICHGAIN and LEANGAIN to initial values RICHGAINo and LEANGAINo respectively. These initial values may range from one to five counts in the present embodiment. The routine then moves to the described step 126.

Step 108, executed after the described step 102 or 106 limits if necessary, the value $\epsilon$ to a predetermined upper limit values of sixteen counts in this embodiment. After limiting $\epsilon$, if necessary, the routine moves to steps 112–118 to provide proportional gain adjustment to the limited $\epsilon$.

Specifically, step 112 is first executed to determine if the present STATE has changed over the most recent prior state as indicated by OLDSTATE. If the state is the same, no proportional compensation is necessary, and such compensation is avoided by moving directly to step 120. Otherwise, the compensation is provided by moving to step 114, to determine the direction of change in state. For example, if the present STATE is RICH, the lean to rich transition from the prior iteration of this routine to the present iteration must be compensated as shown at step 118, at which a proportional rich gain PRICHGAIN is subtracted from $\epsilon$. PRICHGAIN in this embodiment may be set at a value in the range from one to four counts.

Returning to step 114, if the transition was from rich to lean, the compensation of step 116 is provided by adding PLEANGAIN, a lean proportional gain set in the range between one and six counts in the present embodiment, to $\epsilon$. After providing the proportional gain of either of steps 118 or 116, or if such compensation was determined to be unnecessary at step 112, the routine moves to step 120, to store the adjusted $\epsilon$ in controller non-volatile RAM as a function of MODE, the present engine operating mode. The routine then moves to step 122, to reduce Vref by the determined $\epsilon$, to drive Vref in direction to maintain the post-converter sensed exhaust gas oxygen content at a level consistent with efficient conversion of the undesirable exhaust gas constituents, such as at a level at which Vf will be between Vl and Vr, as described.

After adjusting Vref, the routine moves to step 124, to set OLDSTATE to the value STATE, for use in the next iteration of the present routine. The routine is then exited at step 94, to return to any processes that may have been active prior to the start of this routine, as described.

The preferred embodiment for the purpose of illustrating the invention is not to be taken as limiting or restricting the invention since many modifications may be made through the exercise of skill in the art without departing from the scope of the invention.

The embodiments of the invention in which a property or privilege is claimed are described as follows:

We claim:

1. A method for regulating an air/fuel ratio of an internal combustion engine having an exhaust gas treatment means in an engine exhaust gas path through which engine exhaust gas passes, comprising the steps of:

generating an upstream oxygen content signal representing engine exhaust gas oxygen content at a first predetermined position in the exhaust gas path;

generating a downstream oxygen content signal representing engine exhaust gas oxygen content at a second predetermined position in the exhaust gas path;

comparing the downstream oxygen content signal to a predetermined signal range;

adjusting a reference voltage level in direction to drive the downstream oxygen content signal toward the predetermined signal range when the downstream oxygen content signal is not within the predetermined signal range;

determining an oxygen content error signal as a difference between the reference voltage level and the upstream oxygen content signal; and determining a fuel command adjustment as a predetermined function of the oxygen content error signal.

2. The method of claim 1, further comprising the steps of:

sensing predetermined engine operating parameters;

selecting an engine operating mode from a predetermined set of modes as the mode most closely characterizing an engine operating condition represented by the sensed predetermined engine operating parameters; and selecting, from a stored set of reference voltage levels corresponding to the predetermined set of modes, a reference voltage level corresponding to the selected engine operating mode; and wherein the adjusting step adjusts the selected reference voltage level in direction to drive the downstream oxygen content signal toward the predetermined signal range when the downstream oxygen content signal is not within the predetermined signal range.

3. The method of claim 2, further comprising the step of:

updating the selected reference voltage level by storing the adjusted selected reference voltage level with the stored set of reference levels.

4. The method of claim 1, wherein the predetermined signal range represents a range of downstream oxygen content signal levels corresponding to a stoichiometric average engine air/fuel ratio.

5. The method of claim 1, further comprising the step of:

generating a compensation deadband around the adjusted reference voltage level, extending a predetermined upper offset voltage above the adjusted reference voltage level and a predetermined lower offset below the adjusted reference voltage level; and wherein the oxygen content error signal determining step determines an oxygen content error signal as an amount by which the upstream oxygen content signal lies outside the compensation deadband.

6. The method of claim 5, wherein the predetermined upper offset voltage equals the predetermined lower offset voltage.

7. The method of claim 1, wherein the exhaust gas treatment means is disposed between the first and second predetermined positions in the exhaust gas path, and wherein engine exhaust gas passes the first predetermined position prior to passing the second predetermined position.

8. A method of internal combustion engine air/fuel ratio regulation wherein engine exhaust gas oxygen content is sensed by a first oxygen content sensing means prior to being treated by a catalytic converter, and wherein catalytically treated engine exhaust gas oxygen content is sensed by a second oxygen content sensing means, comprising the steps of:

generating a pre-converter oxygen content signal as a predetermined function of an output of the first oxygen content sensing means;

generating a post-converter oxygen content signal as a predetermined function of an output of the second oxygen content sensing means;

comparing the post-converter oxygen content signal to a predetermined signal range representing post-converter oxygen content signal magnitudes corresponding to a stoichiometric average engine air/fuel ratio; and correcting engine air/fuel ratio when the post-converter oxygen content is not within the predetermined signal range, by (a) adjusting a reference voltage level by a predetermined adjustment value, (b) determining a difference between the pre-converter oxygen content signal and the adjusted reference voltage level, and (c) adjusting a magnitude of a predetermined one of the group consisting of an engine inlet air quantity and an engine inlet fuel quantity in direction to mitigate the determined difference.

9. The method of claim 8, further comprising the steps of:

sensing predetermined engine operating parameters;

selecting an engine operating mode from a predetermined set of modes as the mode most closely characterizing an engine operating condition represented by the sensed engine operating parameters; and selecting, from a stored set of reference voltage levels corresponding to the predetermined set of modes, a reference voltage level corresponding to the selected engine operating mode; and wherein the step of adjusting a reference voltage level adjusts the selected reference voltage level by a predetermined adjustment value.

10. The method of claim 9, further comprising the step of:

updating the selected reference voltage level by storing the adjusted selected reference voltage level with the stored set of reference voltage levels.

11. The method of claim 8, further comprising the step of:

generating a compensation deadband around the adjusted reference voltage level, extending a predetermined upper offset voltage above the adjusted reference voltage level and a predetermined lower offset below the adjusted reference voltage level; and wherein the difference determining step determines a difference as the amount by which the pre-converter oxygen content signal exceeds the compensation deadband.

12. The method of claim 11, wherein the predetermined upper offset voltage equals the predetermined lower offset voltage.

* * * * *